US007384488B2

(12) United States Patent
Sandur

(10) Patent No.: US 7,384,488 B2
(45) Date of Patent: Jun. 10, 2008

(54) METHOD FOR PRODUCING GEARS AND/OR SHAFT COMPONENTS WITH SUPERIOR BENDING FATIGUE STRENGTH AND PITTING FATIGUE LIFE FROM CONVENTIONAL ALLOY STEELS

(75) Inventor: Ajithkumar Sandur, Mumbai (IN)

(73) Assignee: Mahindra & Mahindra Ltd, Mumbai (IN)

( * ) Notice: Subject to any disclaimer, the term of this patent is extended or adjusted under 35 U.S.C. 154(b) by 566 days.

(21) Appl. No.: 10/720,010

(22) Filed: Nov. 21, 2003

(65) Prior Publication Data

US 2005/0061402 A1 Mar. 24, 2005

(30) Foreign Application Priority Data

Sep. 18, 2003 (IN) ..... 975/MUM/2003

(51) Int. Cl.
*C23C 8/32* (2006.01)
*C23C 8/56* (2006.01)
*C23C 8/76* (2006.01)

(52) U.S. Cl. ..... 148/219; 148/218; 148/225; 148/230

(58) Field of Classification Search ..... 148/218–219, 148/226, 230; *C23C 8/32, 8/56, 8/76*
See application file for complete search history.

(56) References Cited

U.S. PATENT DOCUMENTS

| | | | | |
|---|---|---|---|---|
| 5,019,182 | A * | 5/1991 | Arimi | 148/219 |
| 5,595,610 | A * | 1/1997 | Maeda et al. | 148/233 |
| 5,595,613 | A * | 1/1997 | Hatano et al. | 148/319 |
| 6,309,475 | B1 * | 10/2001 | Takayama et al. | 148/232 |
| 6,413,328 | B2 * | 7/2002 | Takayama et al. | 148/319 |
| 6,447,619 | B1 * | 9/2002 | Takayama et al. | 148/219 |
| 2002/0119858 | A1 * | 8/2002 | Kino et al. | 475/204 |

* cited by examiner

*Primary Examiner*—Roy King
*Assistant Examiner*—Jessee Roe
(74) *Attorney, Agent, or Firm*—Colin P. Abrahams

(57) ABSTRACT

A conventional aluminum killed alloy steel for case hardening of gear(s) and/or shaft components consisting of 0.10 to 0.30 weight % Carbon, 0.15 to 0.35 weight % Silicon, 0.8 to 1.5 weight % Chromium, 0.6 to 1.5 weight % Manganese, 0.017 to 0.040 weight % Aluminum, and balance iron including impurities, produced by vacuum degassing and alike routes. Gear(s) and/or shaft components made by the above steel when treated by modified carbonitriding followed by hard shot peening process provide both superior bending fatigue strength and pitting fatigue life, capable of withstanding higher torque levels and speeds.

3 Claims, 1 Drawing Sheet

METHOD FOR PRODUCING GEARS AND/OR SHAFT COMPONENTS WITH SUPERIOR BENDING FATIGUE STRENGTH AND PITTING FATIGUE LIFE FROM CONVENTIONAL ALLOY STEELS

FIELD AND BACKGROUND OF THE INVENTION

This invention relates to achieving both superior bending fatigue strength and pitting fatigue life of gear(s) and/or shaft components, using "conventional alloy steel" by a method having following steps in sequence.

Step 1: modified carbonitriding treatment, and

Step 2: hard shot peening process.

Carburizing, hardening and tempering (hereafter called only "carburized") have been followed commonly over years for gear train transmission components in many designs so as to increase load carrying capacity. However, load carrying capability produced after carburizing is limited by microstructural and/or sub microstructural anomalies such as grain boundary oxidation, segregated carbides, bainite and alike anomalies. It has not been possible to extend, beyond certain limits, the load carrying capability of such transmissions without geometrical changes of components. Such geometrical changes in transmissions come with the following significant disadvantages: increases in weight, fuel consumption, development cost, development time and product cost and which ultimately results in increased customer dissatisfaction.

Geometrical changes in transmission components result in weight increase as mentioned above, and impose more loads on engines. Higher engine loads lead to higher emissions. To address higher emission problems, engine designs are required to undergo associated changes to reduce such emissions and this further increases the design and manufacturing costs.

Often space constraints in existing transmissions will make such geometric design changes very difficult to accommodate.

Several other surface treatment related techniques have evolved and been used in recent years to make surfaces and sub-surfaces more durable and reliable for higher torque transmitting capabilities of transmissions, already in use.

Some of the techniques available take advantage of the residual compressive stresses. However, such techniques have limited applications as they make use of special steels and/or elaborate heat treatment processes leading to higher production costs. Further, they are not able to produce simultaneous improvements in bending fatigue strength and pitting fatigue life.

Patent References:

1) U.S. Pat. No. 6,447,619 uses special steels with 0.3 to 3.0 weight % Aluminum and 0.2 to 2.0 weight % Vanadium. The disclosure claims increase in pitting life only and does not address bending fatigue strength, essential for gear(s) and/or shaft of the components. Further the special steel used for processing requires a special steel making process which increases production costs.

2) U.S. Pat. No. 5,595,613 claims to produce superior pitting resistance and wear resistance only with special steels having 1.5 to 5.0 weight % Chromium. The treatment does not address bending fatigue strength. Further, the special steel used for processing requires a special steel making process which increases production costs.

3) U.S. Pat. No. 5,019,182 claims to use a heat treatment route which does not address the tempering process. In the absence of the tempering process after quenching, quenching stresses are not relieved prior to service leading to dimensional instability and susceptibility to cracking. Further, the bending fatigue strength is not addressed in the claim.

In light of the existing prior-art, there has been a long standing demand to provide both superior bending and pitting fatigue life on gear(s) and/or shaft components simultaneously using "conventional alloy steel" which is described as the cheaper, most widely used and widely available steels for gear(s) and/or shaft components. None of the above disclosures provide complete solutions for producing both superior bending fatigue strength and pitting fatigue life simultaneously.

SUMMARY OF INVENTION

It is one object of this present invention to achieve both superior pitting and bending fatigue strengths of gear(s) and/or shaft components simultaneously using "conventional alloy steel" (hereafter called only "conventional steel") which is described as cheaper, most widely used and most widely available for gear(s) and/or shaft components, by a method having the following steps in sequence:

modified carbonitriding treatment, and hard shot peening process.

A second aspect of the present invention is to provide the said method for enhancing load carrying capability of transmissions without geometrical changes resulting in reduction of weights for higher load carrying capability, fuel consumption, development cost, development time and product cost and in turn give higher satisfaction to the customer.

Another aspect of the present invention is to avoid geometrical changes in transmission components resulting in maintaining the same weight and hence lower emission levels for enhanced load carrying capabilities.

Another aspect of the present invention is to provide a solution to the problem of providing additional space in transmissions in case geometric design changes are required to be introduced. The invention is also beneficial in such cases where the space constraints do not permit any geometric changes.

DETAILED DESCRIPTION OF THE INVENTION

Figure 1:
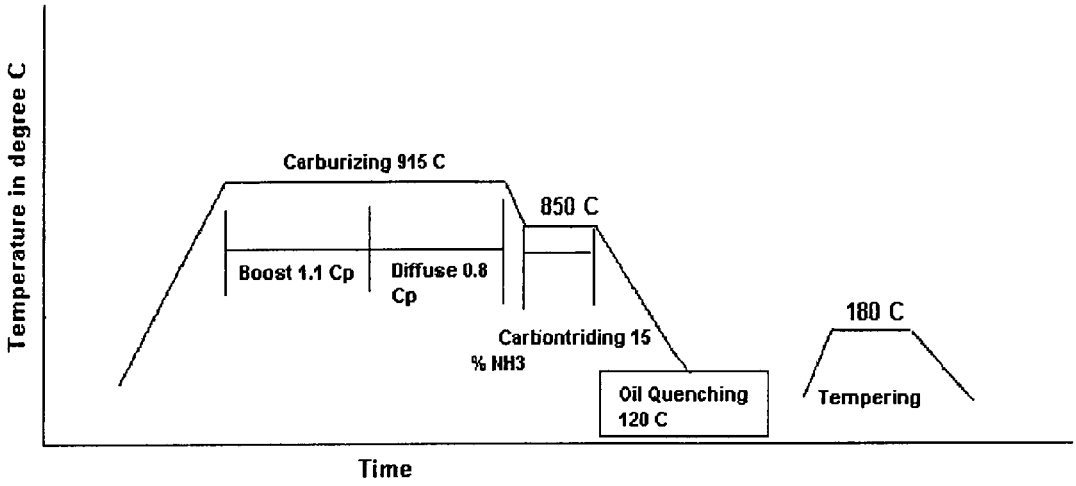
FIG. 1 shows the heat treatment cycle of modified carbonitriding. This is followed by hard shot peening.

The present invention features achieving both superior bending fatigue strength and pitting fatigue life of gear(s) and/or shaft components using "conventional steel" by a method having the following steps in sequence:

modified carbonitriding treatment, and hard shot peening process

"Conventional steel" used in the present invention is either one of the following types:

"Conventional Steel" Type 1:

Steel material comprising 0.10 to 0.30 weight % Carbon, 0.15 to 0.35 weight % Silicon, 0.8 to 1.5 weight % Chromium, 0.6 to 1.5 weight % Manganese, 0.017 to 0.040 weight % Aluminum, and the balance iron including impurities, produced in vacuum degassing and other similar manners.

"Conventional Steel" Type 2:

Steel material comprising 0.10 to 0.30 weight % Carbon, 0.15 to 0.35 weight % Silicon, 0.3 to 1.5 weight % Chromium, 0.30 to 2.0 weight % Nickel, 0.08 to 0.50 weight % Molybdenum, 0.6 to 1.5 weight % Manganese, 0.017 to 0.040 weight % Aluminum m and the balance iron including impurities, produced in vacuum degassing and other similar manners.

The rationale for choosing the "conventional steel" having the said compositions is as follows:

"Conventional Steel" Type 1:

Carbon inherently present in any steel is restricted in the range of 0.1 to 0.3 weight %. Lower than 0.1 weight % will not have sufficient core strength after the present processing. More than 0.3% will lead to core brittleness and reduced toughness. The response to heat a treatment process will also be poor depending on higher Carbon contents.

Silicon is an essential element for de-oxidation of molten steel and hence a minimum of 0.15 weight % is specified to ensure that de-oxidation is effectively taken care of. Higher than 0.35 weight % will entail more silicate inclusions affecting forgeability, machinability and reliability in service. Chromium is an easily available element for increasing hardenability. It is limited between 0.8 to 1.5 weight % to ensure adequate hardenability in the steels for gear(s) and/or shaft components, in combination with Manganese. Higher than the limits will entail intergranular oxidation in the heat treated layers during carburizing.

Manganese is yet another essential element effective in de-oxidation during melting and imparting hardenability. Not less than 0.6 weight % ensures de-oxidation and holds sulphur together. More than 1.5 weight % will lead to forgeability and machinability problems. It is an easily available and cheaper element to increase the hardenability of the material for adequate core strengths and reasonable toughness.

Aluminum content in the range of 0.017 to 0.040 weight % gives fully killed steel and does not contribute significantly in the nitride formation and stabilizing retained Austenite necessitating use of modified carbonitriding treatment for this purpose.

Trace elements like Nb, Ti, Zr, Cu and B are adjusted in such a way that the total contents are below 0.60 weight %. Nitrogen content is kept at 55 to 90 parts per million (ppm) and hydrogen is not more than 2.5 ppm. Calcium and Sulphur are usually added in suitable quantities to improve morphology of inclusions to facilitate machinability.

The steel during melting is treated by a standard vacuum degassing cycle to maintain lower oxygen contents (Oxygen content in the product not more than 20 ppm) and hence limit the size and distribution of inclusions to a degree that the component is fit for the applications already mentioned.

"Conventional Steel" Type 2:

Carbon inherently present in any steel is restricted in the range of 0.1 to 0.3 weight %. Lower than 0.1 weight % will not have sufficient core strength after the present processing. More than 0.3% will lead to core brittleness and reduced toughness. The response to a heat treatment process will also be poor depending on higher Carbon contents.

Silicon is an essential element for de-oxidation of molten steel and hence a minimum of 0.15 weight % is specified to ensure that de-oxidation is effectively taken care of. Higher than 0.35 weight % will entail more silicate inclusions affecting forgeability, machinability and reliability in service.

Chromium is an easily available element for increasing hardenability. It is limited between 0.3 to 1.5 weight % to ensure adequate hardenability in the steels for gear(s) and/or shaft components, in combination with Manganese, Nickel and Molybdenum of suitable quantities mentioned above. Higher than the limits will entail intergranular oxidation in the heat treated layers during carburizing.

Nickel is another essential element effective in ensuring hardenability and improve toughness, required in critical applications. The required quantity is to be not less than 0.3 weight % for ensuring the toughness and hardenability. The upper limit is set to 2 weight % arrived at based on the effect in combination with other elements mentioned above.

Molybdenum is yet another highly effective element in promoting hardenability of the surface and in the core portion. The lower limit is set to 0.08 weight % to be effective in promoting hardenability. The upper limit of 0.5% is set in combination with other elements mentioned above.

Manganese is yet another essential element effective in imparting hardenability, de-oxidation during melting. Not less than 0.6 weight % ensures de-oxidation and holds sulphur together. More than 1.5 weight % will lead to forgeability and machinability problems. It is also an easily available and cheaper element to increase the hardenability of the material for adequate core strengths and reasonable toughness. Aluminum content in the range 0.017 to 0.040 weight % gives fully killed steel and does not contribute significantly in the nitride formation and stabilizing retained Austenite necessitating use of modified carbonitriding treatment for the purpose.

Trace elements like Nb, Ti, Zr, Cu and B are adjusted in such a way that the total contents are below 0.60 weight %. Nitrogen content is kept at 55 to 90 parts per million (ppm) and hydrogen is not more than 2.5 ppm. Calcium and Sulphur are usually added in suitable quantities to improve morphology of inclusions to facilitate machinability.

The steel during melting is treated by a standard vacuum degassing cycle to maintain lower oxygen contents (Oxygen content in the product not more than 20 ppm) and hence limit size and distribution of inclusions to a degree that the component is fit for the applications already mentioned.

Modified Carbonitriding:

The gear(s) and/or shaft components are manufactured as per conventional gear machining practice for highway, off-highway vehicle transmissions and similar industrial transmissions. The said components after machining are loaded in a standard sealed quench furnace having requisite facilities for automatic measurement and feedback mechanisms for carbon potential, temperature and time and facility for ammonia introduction is to be in place. Furnaces other than standard sealed quench furnaces having the above requisite capabilities are also covered in the object of the invention.

The first step in the heat treatment cycle is carburizing (Refer to FIG. 1). The carburizing is done at 915 degrees Centigrade with equal boost and diffusion periods with Carbon potential (Cp) 1.0 and 0.8 respectively, using carrier gas and enricher gases. The temperature of not less than 900 decrees Centigrade at which the carbon diffusion is more pronounced is covered in the invention. The effective case depth covered is in the range of 0.3 to 1.7 mm (cut off hardness 513 Hv). Effective case depths less than 0.3 mm do not provide adequate pitting resistance and more than 1.7 mm have deleterious effects on the fatigue properties for the applications covered in the scope of invention.

At the end of carburizing cycle, the component is cooled inside the furnace to 850 degrees Centigrade and ammonia is introduced with 15% of the whole furnace gas mixture (the rest of the percent being carrier gas). The cycle is carried out for a minimum of 30 minutes. Temperature which is not less than 840 degrees Centigrade and not more than 870 degrees Centigrade is also covered as part of the invention to facilitate pronounced nitrogen diffusion up to a depth of 0.3 mm. Similarly ammonia not less than 15% and not more than 20% of the whole furnace gas mixture is covered for the "conventional steel" in which nitrogen absorbing elements and elements promoting diffusion of nitrogen are not in sufficient quantities.

To minimize distortions in the steel components, quenching in a suitable medium at 120 to 150 decrees Centigrade is maintained in the present invention. Depending on the criticality of the component, the quenching medium temperature of not less than 50 degrees C. is covered in the object of the invention.

Tempering temperature of 180 degrees Centigrade is adopted for the purpose of relieving quenching stresses, without reduction in retained austenite produced after quenching, as above. The temperature not less than 160 degrees Centigrade is covered to relieve quenching stresses.

Hardness after modified carbonitriding is maintained at not less than 740 Hv at a depth of 0.05 to 0.35 mm below the surface. The stresses responsible for pitting (called "Hertzian" stresses) are maximum at depth range mentioned here in the applications mentioned above. The hardness will get further enhanced during hard shot peening and will provide adequate safety against pitting failures for the applications already covered.

The bending fatigue strength, which is a function of maximum residual compressive stress below the surface, is also enhanced by hard shot peening.

Hard Shot Peening:

Further processing by hard shot peening of the gear(s) and/or shaft components has the simultaneous benefits of increasing the bending fatigue strength not less than 30% and pitting fatigue life by more than 3 times. The results have been confirmed in severe, rigorous and accelerated transmission endurance trials for a life time, in comparison with conventional "carburizing" component run with conventional monograde GL-4 gear oil, with oil temperature reaching up to 95 degrees Centigrade. Similar results are covered with GL-4 or higher performance category multigrade oils with the present invention.

The improvement in bending fatigue strength results are further confirmed with residual stress measurements using non-destructive Rigaku X-ray diffraction treatment up to a depth of 150 microns of actual component with conventional "carburizinq" route and "Modified Carbonitriding with Hard Shot Peening" method using "conventional steel". The maximum residual compressive stresses of 1500 Mpa and corresponding bending fatigue strength improvement of 30 to 80% are covered in the present invention.

The roughness and finish of the component surface influences the lubrication condition during engagement with the mating components. Keeping in mind that the gears need to be within the intended surface quality norms, the parameters are limited to the following:

shot size ranging from 0.5 to 0.8 mm,
shot hardness 610 to 800 Hv,
shot velocity 60 to 150 m/sec
part coverage 200 to 500%
Almen A arc height 0.6 to 0.9 mm.

The invention claimed is:

1. A method comprising following steps in sequence for producing both superior bending fatigue strength and pitting fatigue life of gear(s) and/or shaft components made of steel:

(a) applying a carbonitriding treatment, comprising the following steps in sequence:
carburizing at 900 to 1050 degree Centigrade,
cooling down to 840 to 870 degree Centigrade for carbonitriding with 15 to 20% ammonia,
quenching in a medium at 120 to 150 degree Centigrade,
tempering at 160 to 180 degree Centigrade; and (b) applying a hard shot peening process having the following process parameters:
shot size ranging from 0.5 to 0.8 mm,
shot hardness ranging from 610 to 800 Hv, and
shot velocity ranging from 60 to 150 m/sec.

2. The method as claimed in claim 1 wherein said steel material comprises 0.10 to 0.30 weight % Carbon, 0.15 to 0.35 weight % Silicon, 0.8 to 1.5 weight % Chromium, 0.6 to 1.5 weight % Manganese, 0.017 to 0.040 weight % Aluminum, and balance iron including impurities.

3. The method as claimed in claim 1 wherein said steel material comprises 0.10 to 0.30 weight % Carbon, 0.15 to 0.35 weight % Silicon, 0.3 to 1.5 weight % Chromium, 0.30 to 2.0 weight % Nickel, 0.08 to 0.50 weight % Molybdenum, 0.6 to 1.5 weight % Manganese, 0.017 to 0.040 weight % Aluminum and balance iron including impurities.

* * * * *